US012415657B2

(12) United States Patent
Fritz-Vietta et al.

(10) Patent No.: US 12,415,657 B2
(45) Date of Patent: Sep. 16, 2025

(54) FOLDING LID FOR COVERING A CONTAINER OPENING MADE FROM A RECYCLABLE MATERIAL AND ARRANGEMENT AND METHOD FOR PACKAGING AN ITEM

(71) Applicant: Leef Blattwerk GmbH, Potsdam (DE)

(72) Inventors: Claudio Pascal Fritz-Vietta, Berlin (DE); Daniele Grotto, Berlin (DE)

(73) Assignee: Leef Blattwerk GmbH, Potsdam (DE)

( * ) Notice: Subject to any disclaimer, the term of this patent is extended or adjusted under 35 U.S.C. 154(b) by 205 days.

(21) Appl. No.: 17/829,934

(22) Filed: Jun. 1, 2022

(65) Prior Publication Data

US 2023/0182968 A1 Jun. 15, 2023

(30) Foreign Application Priority Data

Dec. 14, 2021 (EP) ..... 21214522.1

(51) Int. Cl.
*B65D 43/02* (2006.01)
*B65D 3/00* (2006.01)

(52) U.S. Cl.
CPC ..... *B65D 43/0202* (2013.01); *B65D 3/00* (2013.01)

(58) Field of Classification Search
CPC .. B65D 43/0202; B65D 3/00; B65D 77/2004; B65D 77/2012
USPC ..... 53/471; 229/123.2, 125.36
See application file for complete search history.

(56) References Cited

U.S. PATENT DOCUMENTS 3,393,860 A * 7/1968 Maki ..... B65D 43/02 229/125.36

FOREIGN PATENT DOCUMENTS

| | | | | |
|---|---|---|---|---|
| EP | 367659 A * | 5/1990 | ..... | B65D 5/2033 |
| EP | 0367659 A2 | 5/1990 | | |
| EP | 3398877 A1 * | 5/1990 | ..... | B65D 81/34 |
| FR | 1124150 A | 10/1956 | | |
| WO | WO-2020014183 A1 * | 1/2020 | ..... | A47J 47/14 |

* cited by examiner

*Primary Examiner* — Jacob A Smith

(57) ABSTRACT

A folding lid is presented for covering a container opening made from a recyclable material. The folding lid includes: a base element, an accommodating opening, which is formed in the base element and configured to accommodate a container for an item to be packaged in such a manner that a container opening of the container is arranged in the region of the accommodating opening, and at least three wing elements, which are integrally formed onto the base element circumferentially via a respective folding region along an outer edge of the base element with respect to the accommodating opening; wherein the at least three wing elements can each be pivoted between an open position, in which the accommodating opening is cleared, and a closed position, in which the at least three wing elements cover the accommodating opening completely, wherein adjacent wing elements of the at least three wing elements at least partially overlap in the closed position.

13 Claims, 6 Drawing Sheets

FOLDING LID FOR COVERING A CONTAINER OPENING MADE FROM A RECYCLABLE MATERIAL AND ARRANGEMENT AND METHOD FOR PACKAGING AN ITEM

CROSS-REFERENCE TO RELATED APPLICATIONS

This application claims the benefit and priority of European Patent Application No. 21214522.1, filed Dec. 14, 2021. The entire disclosure of the above application is incorporated herein by reference.

FIELD

The invention relates to a folding lid for covering a container opening made from a recyclable material and an arrangement and a method for packaging an item.

BACKGROUND

This section provides background information related to the present disclosure which is not necessarily prior art.

For packaging, items can be accommodated in a container, for example a tray, a folding box or a cardboard box, wherein a container opening, through which the items are introduced in the container, is then closed using a lid. For example, it is known in connection with folding cardboard boxes that the lid is formed using lid elements, which are pivoted from outside inwards for closing the cardboard box opening, so that the lid elements partially overlap with one another in the position closing the cardboard box opening.

SUMMARY

This section provides a general summary of the disclosure, and is not a comprehensive disclosure of its full scope or all of its features.

The object of the invention is to create a folding lid for covering a container opening made from a recyclable material and an arrangement and a method for packaging an item, using which a lid can be provided in a flexible manner for different containers.

To achieve this, a folding lid for covering a container opening made from a recyclable material according to the independent claim 1 and an arrangement and a method for packaging an item according to the claims 11 and 16 are created. Embodiments are the subject-matter of dependent claims.

According to one aspect, a folding lid is provided for covering a container opening made from a recyclable material, which folding lid comprises the following: a base element; an accommodating opening, which is formed in the base element and configured to accommodate a container for an item to be packaged in such a manner that a container opening of the container is arranged in the region of the accommodating opening; and at least three wing elements, which are formed or moulded integrally, i.e. in one piece, onto the base element circumferentially via a respective folding region along an outer edge of the base element with respect to the accommodating opening. The at least three wing elements can each be pivoted between an open position, in which the accommodating opening is cleared, and a closed position, in which the at least three wing elements cover the accommodating opening completely or all-over, wherein adjacent wing elements of the at least three wing elements at least partially overlap in the closed position, particularly with a view from above onto the folding lid.

According to a further aspect, an arrangement for packaging an item is provided, which comprises the following: a container made from a recyclable material with a container opening, wherein the container is configured to accommodate an item (via the container opening), and a folding lid of the previously mentioned type. The container is accommodated in the accommodating opening of the base element of the folding lid in such a manner that the container opening is arranged in the region of the accommodating opening, and each of the at least three wing elements is arranged in the closed position and thus cover the accommodating opening completely.

A further aspect relates to a method for packaging an item, comprising: providing a folding lid; providing a container made from a recyclable material with a container opening; arranging an item in the container through the container opening; arranging the container in the accommodating opening of the base element of the folding lid in such a manner that the container opening is arranged in the region of the accommodating opening; and pivoting each of the at least three wing elements out of the open position into the closed position, so that the accommodating opening is completely covered by means of the at least three wing elements. The item can be introduced into the container before and/or after the arrangement of the container in the accommodating opening.

With the aid of the proposed technology, it is made possible to produce the folding lid made from recyclable material independently of the container, individually. After the production of the folding lid, the container, the container opening of which should be hidden or covered with the aid of the folding lid, can be introduced into the accommodating opening of the base element of the folding lid, in order subsequently to pivot each of the at least three wing or lid elements into the closed position, so that the accommodating opening of the base element and thus the container opening of the container arranged therein is covered and closed completely. In the packaging arrangement, containers on the one hand and folding lids on the other hand can be produced independently of one another, for example from different materials or in the case of the same materials, optionally using different production steps.

For example, it is therefore made possible to provide an arrangement for packaging a food, which is accommodated in the container and can then be packaged in a closed manner with the aid of the folding lid.

The at least three wing elements can be formed at least in the region of the integral forming or moulding onto the base part with identical element width along the outer edge of the base element. The at least three wing elements can be realized in an identically shaped manner and substantially with identical dimensions.

With a view from above onto the folding lid, the base element may have a triangular or quadrilateral shape, wherein the latter is at least a quadrilateral shape. Along the straight edge regions, the wing elements are integrally formed onto the base element.

The accommodating opening in the base element, which is used to accommodate the container, may have a round or an angular cross section. The internal wall surrounding the accommodating opening in an encompassing manner, compared with the outer edge, may be constructed circumferentially continuously around the accommodating opening.

The folding lid may for example be produced from a paper or a paperboard material, wherein a material coating may optionally be provided.

The at least three wing or top elements can be integrally formed onto the base element continuously circumferentially along the outer edge of the same. In this embodiment, the at least three wing elements, which are formed onto the base element along the outer edge, cover the outer edge continuously circumferentially, which supports as tight as possible a closure of the container opening by the wing elements in the closed position.

Adjacent wing elements of the at least three wing elements may overlap in the closed position starting in a proximal wing element section, which is formed starting from the integral forming or moulding onto the base element. Even starting from the region of the integral forming of the at least three wing elements onto the base element, an overlap takes place here between regions of adjacent wing elements.

Adjacent wing elements of the at least three wing elements may overlap in the closed position in a wing element section, which is distal with respect to the integral forming on the base element. In this configuration, the overlap is formed at least between the adjacent of the wing elements in the region of the wing element sections, which are formed on the base element distally with respect to the region of the integral forming of the wing element onto the base element.

The adjacent of the at least three wing elements may overlap continuously in the closed position starting in the proximal wing element section up to the distal wing element section. In this exemplary embodiment, the overlap between sections of adjacent wing elements extends continuously starting from the proximal region of the wing elements adjacent to the integral moulding or forming on up to the distal region of the wing elements, which further supports a closure of the container opening in as tight a manner as possible with the aid of the folding lid.

A bearing surface can be formed on the base element circumferentially around the accommodating opening, which bearing surface is configured to support a container edge during the arrangement of the container in the accommodating opening. In an embodiment, the base element can be reinforced in the region of the bearing surface, for example by means of a larger material thickness. The container edge of the container comes to bear (touch contact) in the region of the bearing surface, when the same is arranged in the accommodating opening, whether this be circumferentially around the accommodating opening in a continuous or interrupted manner. In this manner, the container is prevented from slipping through the accommodating opening and thus can be arranged securely in the accommodating opening of the base element. The container edge of the container forms a type of stop, up to which the container can be introduced into the accommodating opening and through the same.

The folding region can be formed with a respective folding line, along which the wing element can be folded during pivoting between the open and the closed position. The respective folding line can be formed using one or more points of material weakening, so that predetermined bending or folding points are provided, which facilitate the pivoting or folding of the wing elements. In this or other configurations, the folding lines can run along the outer edge of the base element, congruently with the same.

The folding lines of adjacent wing elements of the at least three wing elements can be formed to abut at the end side. In this embodiment, a folding line is formed to run continuously around the base element, along which folding line the at least three wing elements are formed integrally onto the base element.

The at least three wing elements can each have a curved or arcuate edge contour circumferentially starting from the integral forming onto the base element. The curvature may for example be a concave curvature.

In the closed position, the at least three wing elements may be arranged to hold the closed position on their own, owing to the overlap. Here, the wing elements may be arranged to be self-holding in the closed position, free from additional securing means, that is to say free from adhesives, which may be provided in other configurations, in order to secure the wing elements in the closed position. Inserting or sliding into one another to form the overlap between the wing elements may support the self-holding or -securing arrangement of the wing elements in the closed position, when the container opening is closed or covered thereby.

The configurations previously described in connection with the folding lid can correspondingly be provided in connection with the arrangement for packaging an item.

In the arrangement, the container edge of the container can be supported on the bearing surface, which is formed on the base element circumferentially around the accommodating opening in a continuous or interrupted manner. The support of the container edge of the container arranged in the accommodating opening of the base element on the bearing surface may be formed circumferentially in a continuous or interrupted manner.

The container may for example be a container tray. In an embodiment, the container is produced from a leaf material of a plant. Even in the case of other configurations of the container, such as plates, cups or bowls, construction of the container from the plant material may be provided. In this or other configurations, a food may be accommodated in the container, which is then packaged with the aid of the folding lid. A palm leaf may for example be used as leaf material, which is processed in a manner known per se to form a container.

At least a portion of the wing elements, which are arranged opposite one another in an exemplary embodiment, may have a grip tab in the region of the distal wing element section, which may for example extend externally in (only) one half of the assigned wing element. The grip tabs may engage into one another in the folded or folded-in state, so that the wing elements are arranged in a self-holding manner in the folded position.

Edge sections in which adjacent wing elements of the wing elements abut can be arranged internally in such a manner that wing part elements are arranged externally thereto, which are formed integrally onto the adjacent wing elements in a foldable manner in each case, which further supports a tight closure by means of the further folding lid in corner regions of the folded folding lid.

The following can be provided during the production of the container: providing a container material made from a leaf material of a plant; moulding the container material to form a three-dimensional packaging container with a container opening and a container edge surrounding the container opening; and producing a sealing edge on a top surface of the container edge, wherein the top surface of the container edge is ground by means of grinding.

A palm leaf may be used as leaf material, optionally a cutting of the palm leaf. During the production of the container, a blank is produced by means of moulding in a mould by applying pressure and temperature starting from the container material (palm leaf), in order to then form the sealing edge. Here, the edge is ground in a smoothing manner in a grinding process.

After the arrangement of the item in the three-dimensional packaging container through the container opening, the container opening can be closed in an exemplary embodiment initially (additionally) by means of a sealing film, wherein the sealing film is here connected to the sealing edge adhesively without adhesive. In this configuration, the folding lid forms an outer cover of the container opening, which is already provided with the sealing film.

In an embodiment, the container has the following: a three-dimensional packaging container made from a leaf material of a plant; a container opening; a container edge, which is formed on the three-dimensional packaging container surrounding the container opening; and a sealing edge, which is formed on a top surface of the container edge as a ground surface, optionally (after the introduction of the item) a seal, which is provided using a sealing film, which is connected to the sealing edge adhesively without adhesive.

The sealing connection between the sealing film and the container edge can here be produced exclusively in the region of the sealing edge, which was produced previously by means of grinding in the region of the top surface of the container edge. At least the underside of the container edge is then free in a material-saving manner of the sealing film, which therefore does not have to be folded over downwards from the top surface around the outer edge of the container edge.

The formulation "without adhesive" in the sense of the present application means that no adhesive is used in addition to the sealing film during sealing. The sealing film itself may in a possible configuration have a lacquer coating (sealing lacquer) on the surface-side, which sealing lacquer melts at least partially during sealing, as a result of which the adhesion of the sealing film on the sealing edge is formed alone or is supported.

In the exemplary embodiment, it is made possible to close the three-dimensional packaging container produced from a plant material after the introduction of the item to be packaged by means of the sealing film, in that a closed sealing connection is formed between the sealing edge on the top surface of the container edge and the sealing film. The container edge is ground to produce the sealing closure, so that the sealing edge is provided, into the region of which the adhesive (but adhesive-free) connection to the sealing film is produced. To form the sealing edge, in the region of the top surface of the container edge, residues are for example removed by means of grinding, which residues may be deposited here during the previously executed moulding of the container material and may hinder the formation of the adhesive connection to the sealing film. Also, the surface contour in the region of the top surface of the container edge can be influenced in a targeted manner by means of grinding to produce the sealing edge. As a result, it is subsequently made possible, without additional adhesive, to form a good adhesive connection between the sealing film and the three-dimensional packaging container in the region of the sealing edge.

A plastic film can be used as sealing film. It may be provided that the sealing film is produced as a biodegradable film, particularly made from a biodegradable plastic. The sealing film may be formed as a single- or multi-layered material. The sealing film may consist of an oil-based plastic, for example PET (polyethylene terephthalate) or the like. Other plastics may also be used, for example based on a PLA plastic (PLA—polylactic acid) or a PAH plastic (PAH—polycyclic aromatic hydrocarbons).

The previously described configurations may correspondingly be provided in connection with the method for packaging an item.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Further exemplary embodiments are explained in the following with reference to figures of a drawing. In the figures.

Figure 5:
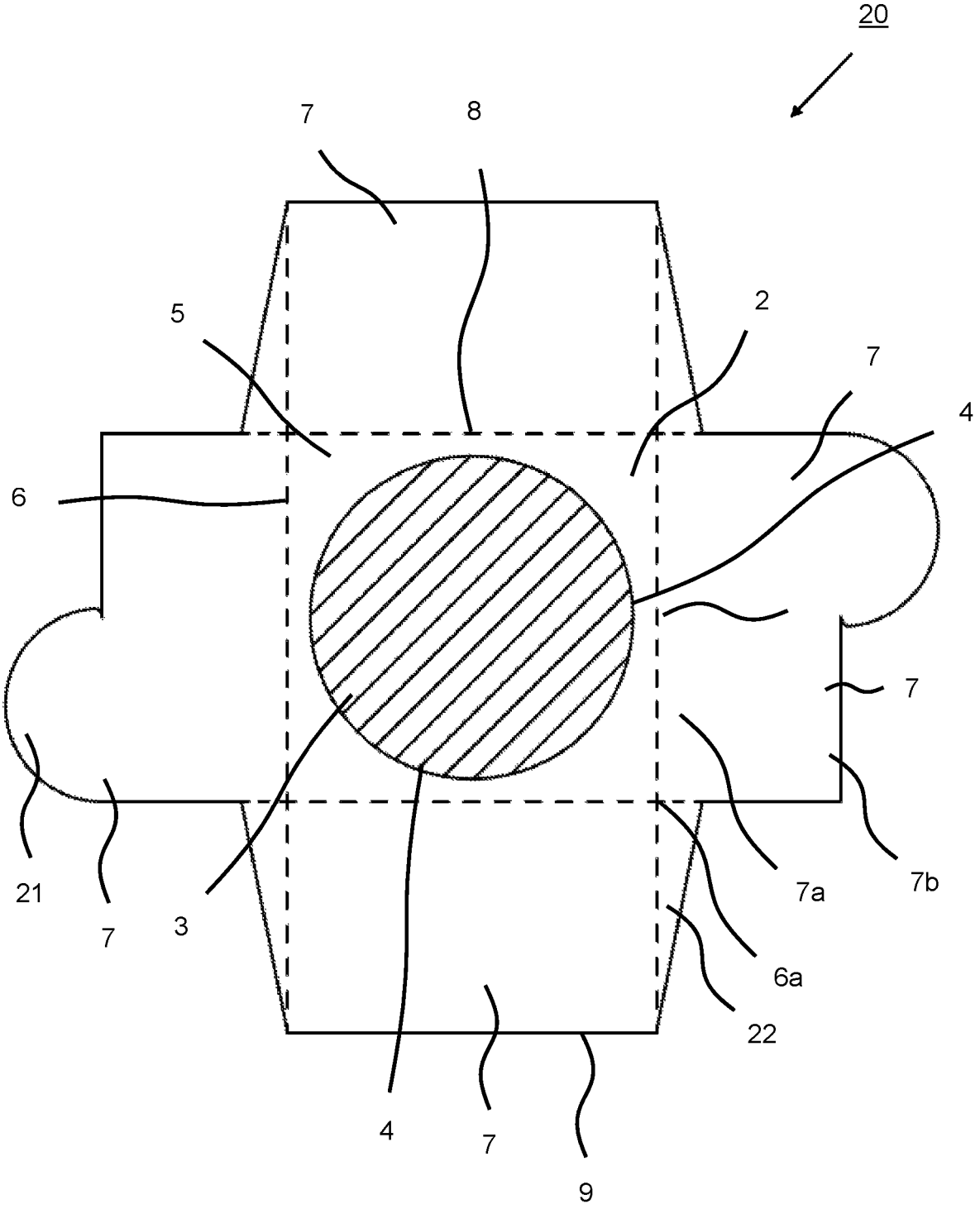
Figure 6:
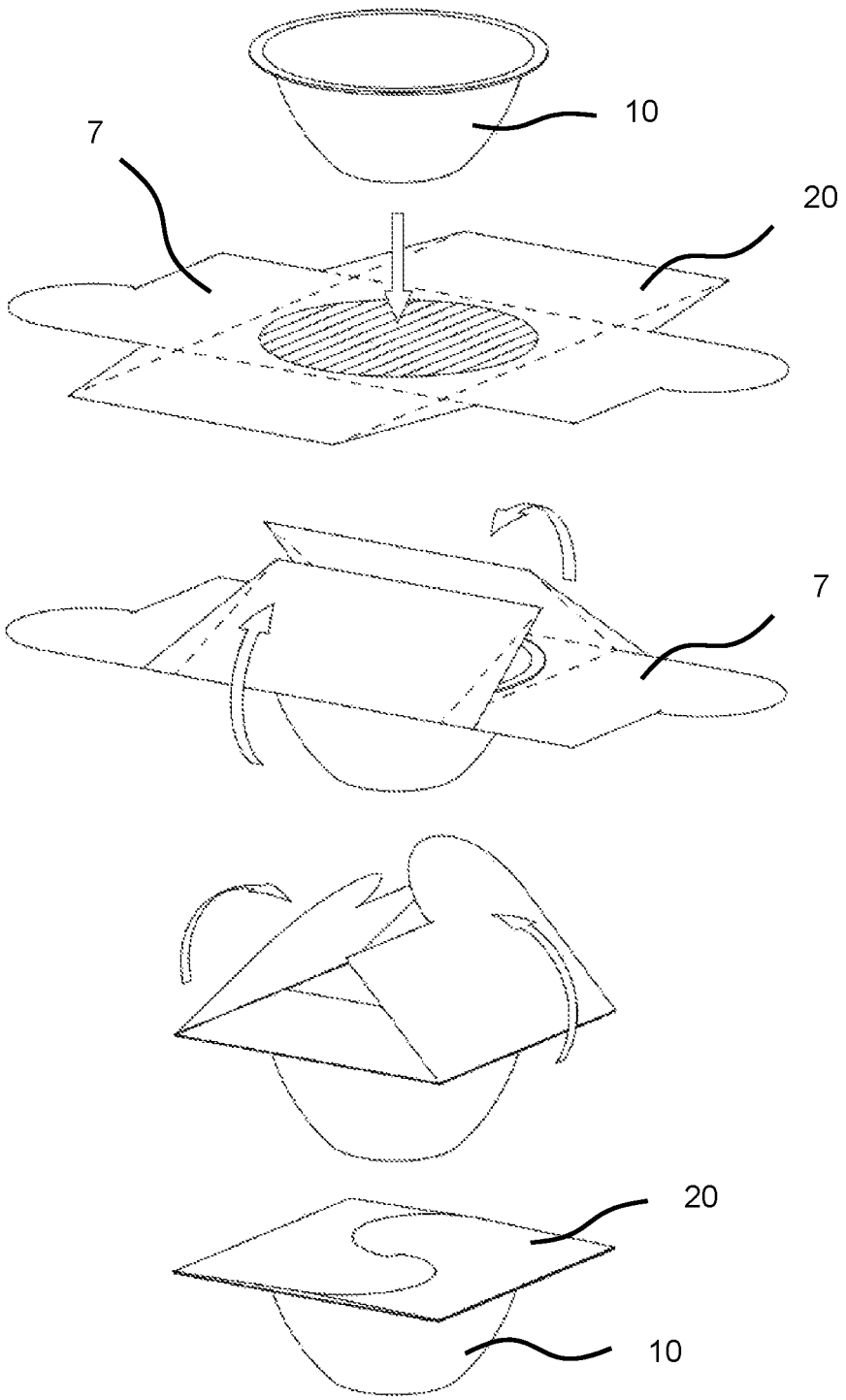

FIG. 5 shows a schematic illustration of a further folding lid with circumferentially arranged wing elements in an open position from above; and FIG. 6 shows a schematic illustration of an arrangement with the further folding lid from FIG. 5 and a container, which is accommodated in the accommodating opening of the further folding lid and the container opening of which is then covered by means of the wing elements of the further folding lid.

Corresponding reference numerals indicate corresponding parts throughout the several views of the drawings.

DETAILED DESCRIPTION

Example embodiments will now be described more fully with reference to the accompanying drawings.

Figure 1:
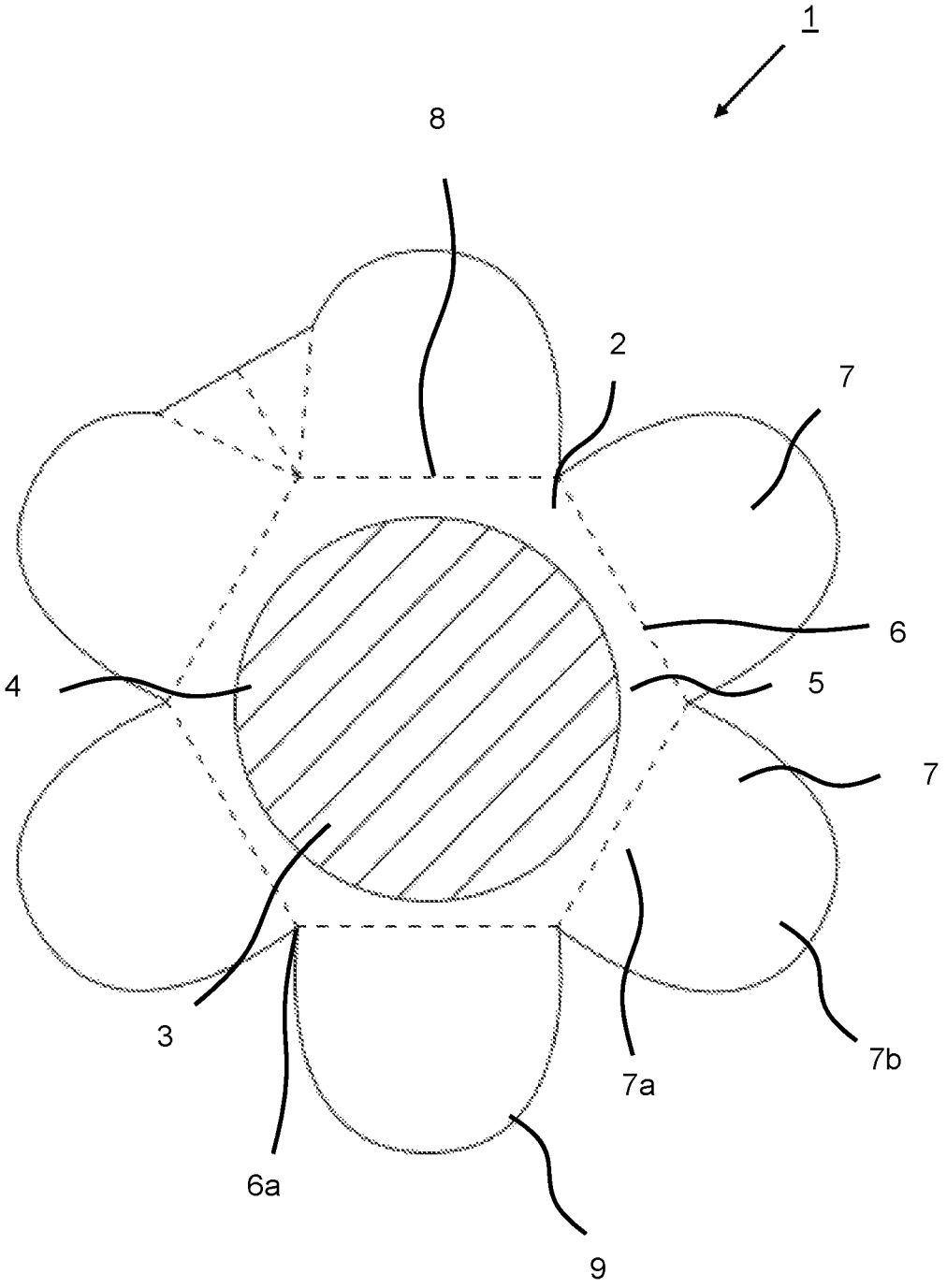
FIG. 1 shows a schematic illustration of a folding lid with circumferentially arranged wing elements in an open position from above.

FIG. 1 shows a schematic illustration of a folding lid 1 from above. A base element 2 has an accommodating opening 3, which is constructed as an aperture (hatched). In the embodiment illustrated, the accommodating opening 3 has a round cross section. Alternatively, the cross section may also be formed in an angular manner.

A bearing surface 5 is formed on the base element 2 circumferentially around an (internal) opening edge 4 of the accommodating opening 3.

Wing elements 7 are integrally formed circumferentially onto the base element 2 along an outer edge 6 of the base element 2. A respective folding or bending line 8 is assigned to the wing elements 7, which runs along the outer edge 6 of the base element 2, for example as a materially weakened region, wherein adjacent folding lines 8 abut at their ends. In the example shown, the wing elements 7 extend continuously circumferentially along the outer edge 6.

In the illustrated embodiment, the wing elements 7 are constructed to be identical in terms of shape and size and have a convex edge contour 9.

A proximal wing element section 7*a* is arranged adjacently to the assigned folding line 8, that is to say the outer edge 6, and extends starting from the same. On the opposite side, the wing elements 7 have a distal (outer) wing element section 7*b*.

In edge sections 6*a*, adjacent wing elements 7 of the wing elements 7 abut.

Figure 2:
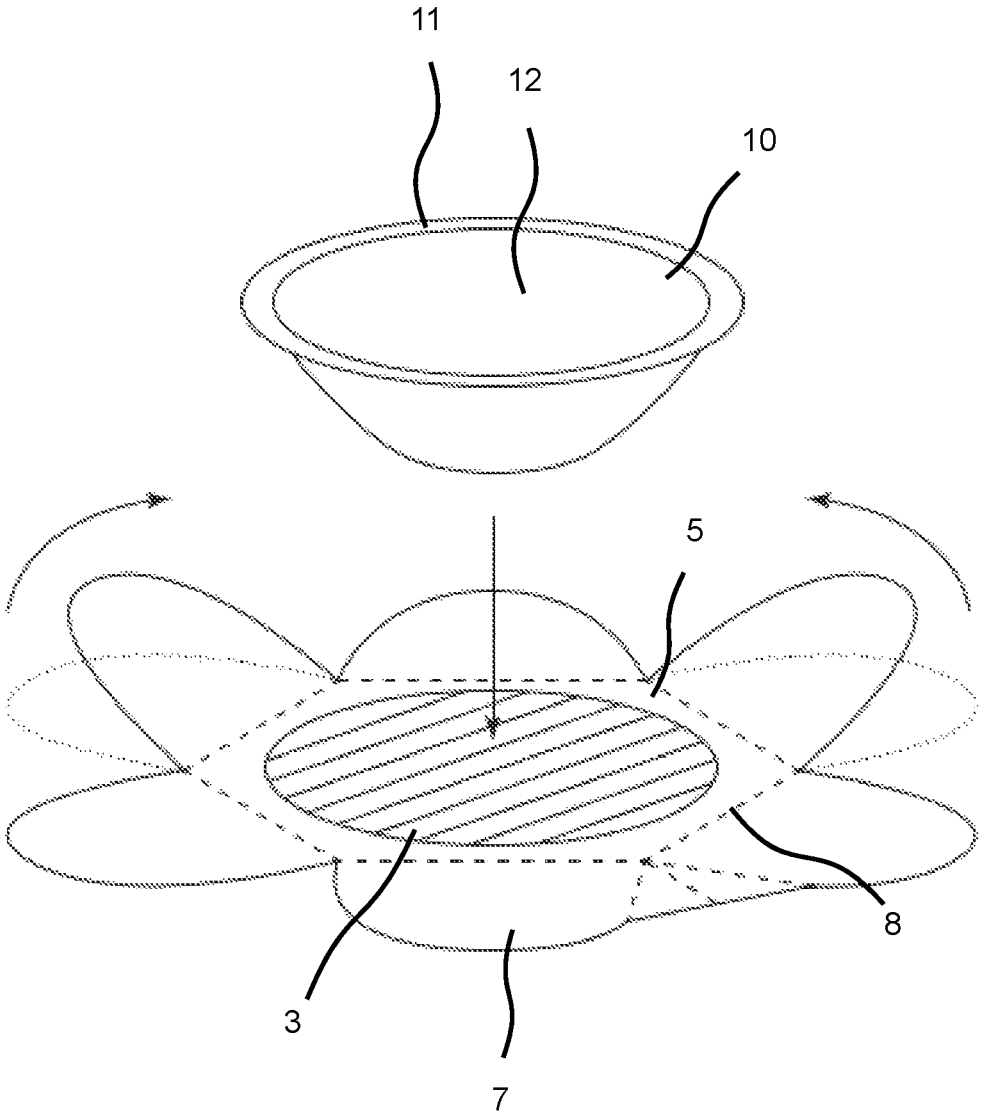
FIG. 2 shows a schematic illustration of an arrangement with the folding lid from FIG. 1 and a container arranged over the same, wherein wing elements of the folding lid are arranged in an open position.

FIG. 2 shows a schematic illustration of an arrangement, in which a container 10 with a container edge 11 is arranged above the folding lid 1, wherein the container is a tray in the illustrated embodiment, which tray consists of a leaf material of a plant for example. The container 10 has a container opening 12, which is surrounded by the container edge 11 and through which an item to be packaged can be introduced into the container 10, for example a food. The container edge 11 protrudes laterally.

Figure 3:
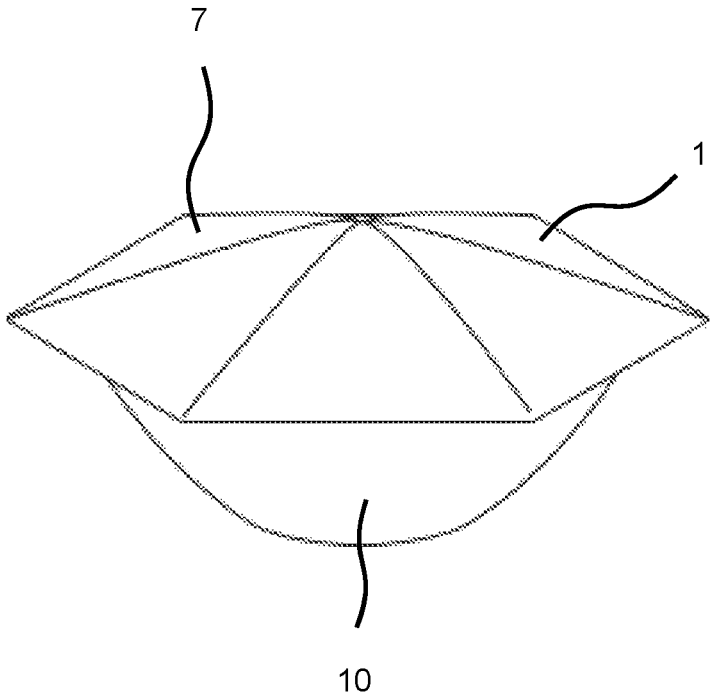
FIG. 3 shows a schematic illustration of the arrangement from FIG. 2, wherein the container is now arranged in an accommodating opening of the folding lid and the container opening of the container is covered or closed with the aid of the wing elements of the folding lid in the closed position.

In order to package the item (not illustrated) accommodated in the container 10, the container 10 is arranged in the accommodating opening 3 of the folding lid 1 in such a manner that the container edge 11 is supported on the base element 2 along the bearing surface 5 around the accommodating opening 3. Thus, the wing elements 7 can be folded or pivoted out of the open position shown in FIG. 2 into the closed position shown in FIG. 3, in order to close the container opening 12 completely or all-over. An item accommodated in the container 10 is packaged in this manner. The container 10 projects on the underside of the base element 2 of the folding lid 1 in the manner shown in FIG. 3.

Figure 4:
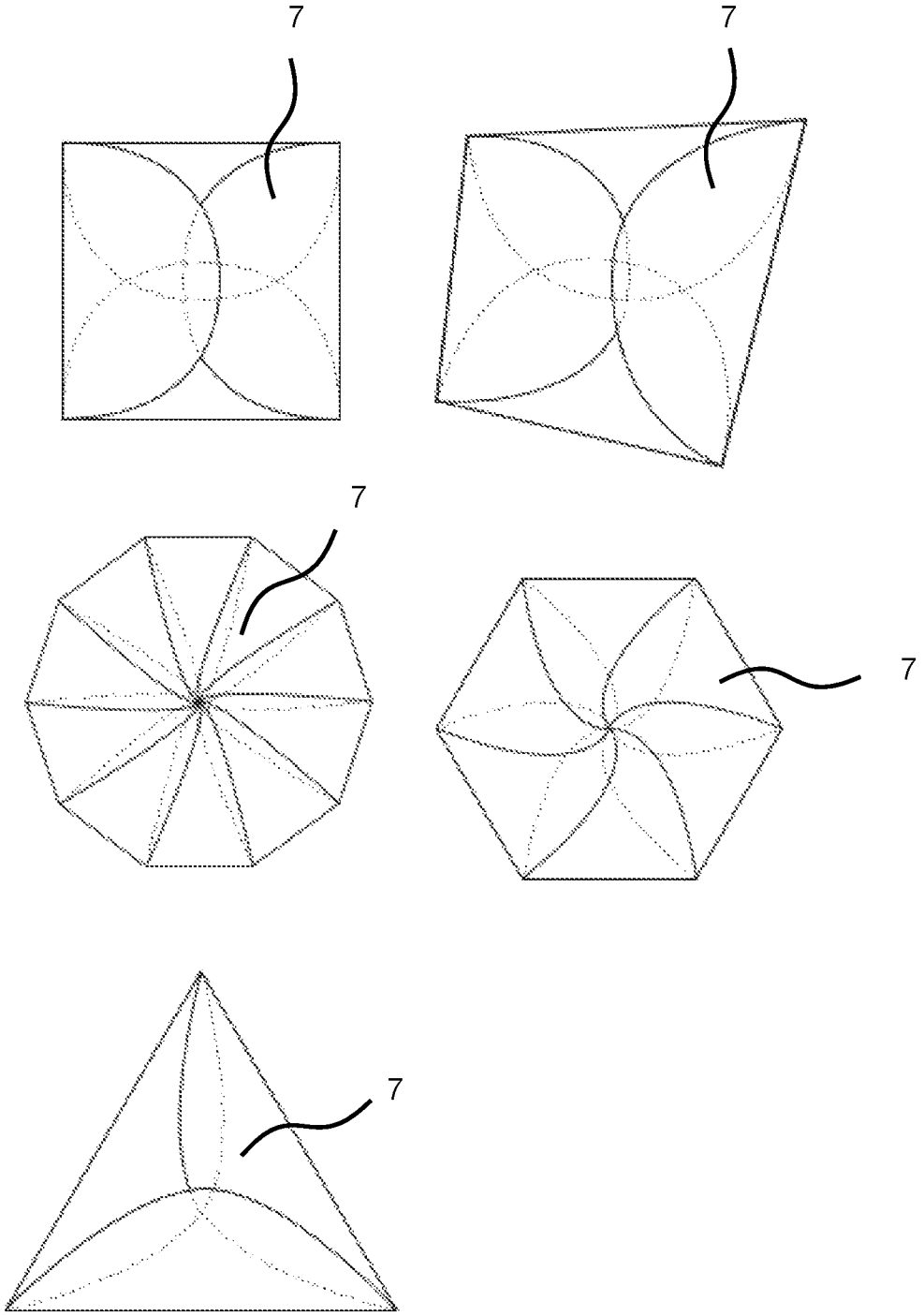
FIG. 4 shows a schematic illustration of further folding lids in different embodiments.

FIG. 4 shows schematic illustrations of further folding lids, which—comparable to the embodiment in FIGS. 1 and 2—each have the accommodating opening 3 in the base part 2 and the wing elements 7 integrally formed thereon circumferentially, which wing elements are each pivoted into the closed position in the illustrations in FIG. 4.

The result is that in the exemplary embodiments shown, the adjacent wing elements 7 overlap at least in certain sections, wherein the overlap can extend, optionally continuously, starting from the proximal wing element section 7*a* up into the distal wing element section 7*b*. A closure of the container opening 12, which is as tight as possible, is achieved in this manner.

As emerges from FIGS. 1 to 4, at least three wing elements 7 are provided, which in each case continuously encompass the circumferential outer edge 6 of the base element 2. Here, the outer edge 6 has a triangular shape or a quadrilateral shape (at least a quadrilateral shape) with a view from above according to FIG. 4.

FIGS. 5 and 6 show a schematic illustration of a further folding lid 20 with circumferentially arranged wing elements 7 and an arrangement with the further folding lid 20 and a container 10. The same reference numbers are used for the same features in FIGS. 5 and 6 as in the preceding figures.

According to FIG. 6, the container 10 is accommodated in the accommodating opening 3 of the further folding lid 20, and the container opening 12 thereof is then covered by means of the four circumferentially arranged wing elements 7 of the further folding lid 20.

At least a portion of the wing elements 7, which are arranged opposite one another in the exemplary embodiment, have a grip tab 21 in the region of the distal wing element section 7*b*, which in the example shown extends in half of the assigned wing element 7. The grip tabs 21 engage into one another in the folded state (cf. in FIG. 6 below), so that the wing elements 7 are arranged in a self-holding manner in the folded position.

In the alternative configuration according to FIG. 5, the edge section 6*a*, in which adjacent wing elements 7 abut is designed internally in such a manner that wing part elements 22 are arranged externally thereto, which are each integrally formed onto the adjacent wing elements 7 in a foldable manner, which further supports a tight closure by means of the further folding lid 20 in corner regions of the folded folding lid.

The features disclosed in the above description, the claims, and the drawing can be of significance both individually and in any combination for the implementation of the different embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An arrangement for packaging an item, comprising:

a container made from a recyclable material with a container opening, wherein the container is configured to accommodate an item; and a folding lid for covering the container opening of the container, wherein the folding lid is comprised of a base element;

an accommodating opening, which is formed in the base element and configured to accommodate a container for an item to be packaged in such a manner that a container opening of the container is arranged in the region of the accommodating opening; and at least three wing elements, which are integrally formed onto the base element circumferentially along a respective folding region along an outer edge of the base element with respect to the accommodating opening;

wherein the at least three wing elements can each be pivoted between an open position, in which the accommodating opening is cleared, and a closed position, in which the at least three wing elements cover the accommodating opening completely, wherein adjacent wing elements of the at least three wing elements at least partially overlap in the closed position;

wherein the container is accommodated in the accommodating opening of the base element of the folding lid in such a manner that the container opening is arranged in the region of the accommodating opening, and the at least three wing elements are each arranged in the closed position and thus cover the accommodating opening completely, wherein the container consists of a cutting of a palm leaf.

2. The arrangement according to claim 1, characterized in that the at least three wing elements are formed integrally onto the base element continuously circumferentially along the outer edge of the base element.

3. The arrangement according to claim 1, characterized in that the adjacent wing elements of the at least three wing elements overlap in the closed position starting in a proximal wing element section, which is formed starting from the integral forming onto the base element.

4. The arrangement according to claim 1, characterized in that the adjacent wing elements of the at least three wing elements overlap in the closed position in a distal wing element section, which is distal with respect to the integral forming on the base element.

5. The arrangement according to claim 3, characterized in that the adjacent wing elements of the at least three wing elements overlap continuously in the closed position starting in the proximal wing element section up to the distal wing element section).

6. The arrangement according to claim 1, characterized in that a bearing surface is formed on the base element circumferentially around the accommodating opening, which bearing surface is configured to support a container edge during the arrangement of the container in the accommodating opening.

7. The arrangement according to claim 1, characterized in that the folding region is formed with a respective folding line, along which the wing element can be folded during pivoting between the open and the closed position.

8. The arrangement according to claim 7, characterized in that the folding lines of the adjacent wing elements of the at least three wing elements are formed to abut at the end side.

9. The arrangement according to claim 1, characterized in that the at least three wing elements each have a circumferential curved or arcuate edge contour starting from the integral forming onto the base element.

10. The arrangement according to claim 1, characterized in that, in the closed position, the at least three wing elements are arranged to hold the closed position by themselves, owing to the overlap.

11. The arrangement according to claim 1, characterized in that a container edge of the container is supported on a bearing surface, which is formed on the base element circumferentially around the accommodating opening.

12. The arrangement according to claim 11, characterized in that the container edge of the container is supported on the bearing surface continuously circumferentially around the accommodating opening.

13. A method for packaging an item, comprising:

providing a folding lid according to claim 1;

providing a container made from a recyclable material with a container opening, wherein the container consists of a leaf material of a cutting of a palm leaf;

arranging an item in the container through the container opening;

arranging the container in the accommodating opening of the base element of the folding lid in such a manner that the container opening is arranged in the region of the accommodating opening; and pivoting each of the at least three wing elements out of the open position into the closed position, such that the accommodating opening is completely covered by means of the at least three wing elements.

* * * * *